US005663693A

United States Patent [19]

Doughty et al.

[11] Patent Number: 5,663,693

[45] Date of Patent: Sep. 2, 1997

[54] DIELECTRIC WAVEGUIDE POWER COMBINER

[75] Inventors: Glenn R. Doughty, Plano, Tex.; John A. Higgins, Los Angeles, Calif.; Richard L. Kaiser, Dallas; Sam K. Buchmeyer, Garland, both of Tex.

[73] Assignee: Rockwell International, Seal Beach, Calif.

[21] Appl. No.: 521,694

[22] Filed: Aug. 31, 1995

[51] Int. Cl.[6] ..... H01P 5/12

[52] U.S. Cl. ..... 333/125; 330/295; 333/137

[58] Field of Search ..... 333/26, 125, 128, 333/137; 330/286, 295

[56] References Cited

U.S. PATENT DOCUMENTS

| | | | |
|---|---|---|---|
| 3,105,946 | 10/1963 | Beljers et al. | 333/24.2 |
| 4,291,278 | 9/1981 | Quine | 333/128 X |
| 4,473,828 | 9/1984 | Mörz et al. | 333/137 X |
| 4,588,962 | 5/1986 | Saito et al. | 330/286 |
| 4,764,775 | 8/1988 | Craven | 333/125 X |
| 4,835,496 | 5/1989 | Schellenberg et al. | 333/125 X |
| 5,066,925 | 11/1991 | Freitag | 330/286 X |

*Primary Examiner*—Paul Gensler
*Attorney, Agent, or Firm*—M. Lee Murrah; George A. Montanye

[57] ABSTRACT

A transmission medium consists of a dielectric waveguide shielded by a metal guide. The guide is particularly suitable for providing low insertion loss, convenient transfer of power from one such transmission line to another and for the trouble free handling of high power levels at many hundreds of watts. This type of transmission medium may be used to provide low loss combination of power signals that is low loss, compact while containing the solid state power amplifying elements (MMICs) and capable of high power.

7 Claims, 4 Drawing Sheets

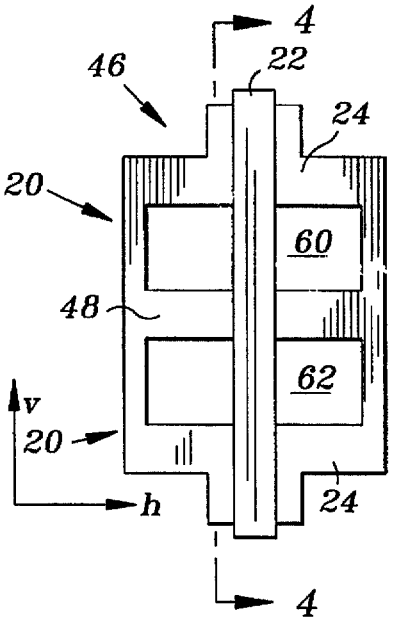
FIG. 3
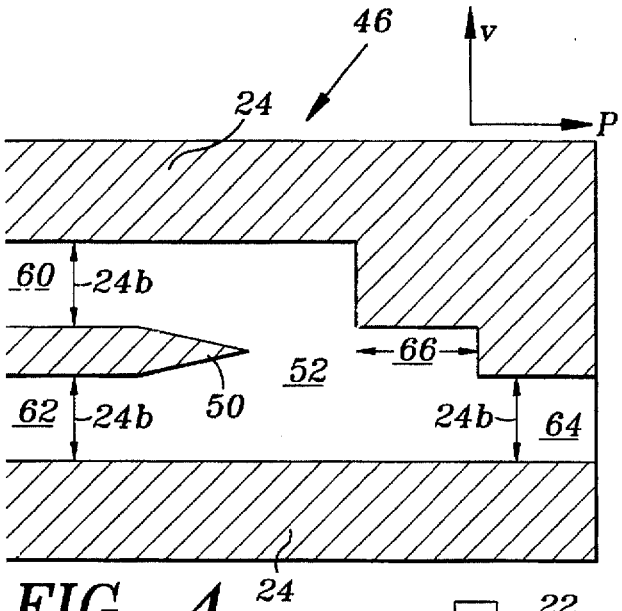
FIG. 4
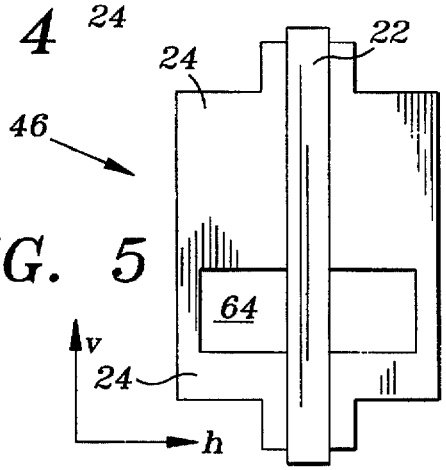
FIG. 5
FIG. 6a
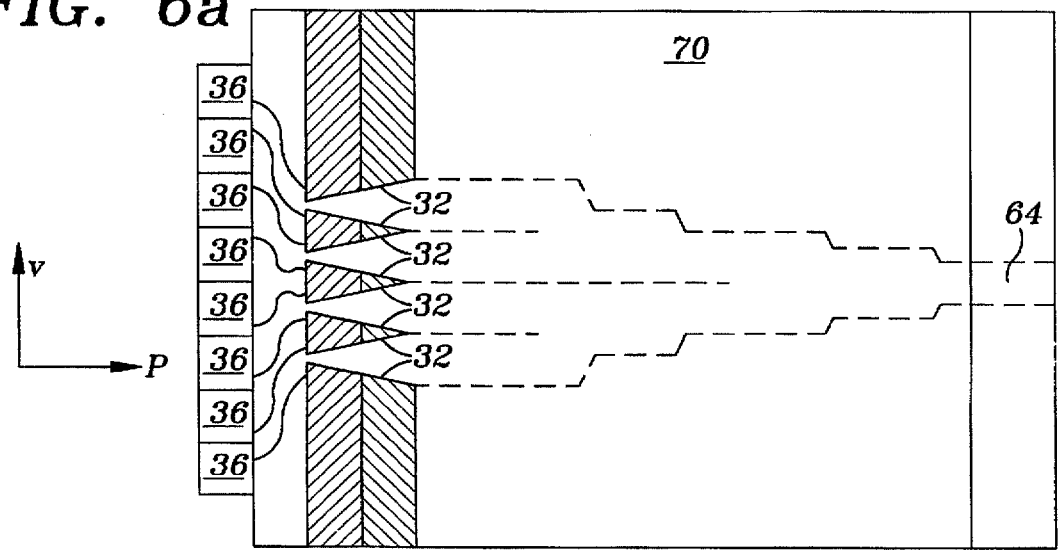
FIG. 6b
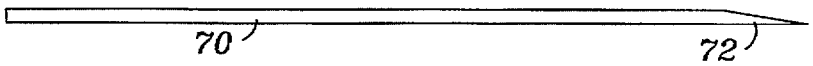

DIELECTRIC WAVEGUIDE POWER COMBINER

BACKGROUND OF THE INVENTION

Power amplifiers are utilized in communications systems to produce sufficient transmitter power to maintain adequate signal to noise ratio. Solid state power amplifiers are particularly desirable because they are efficient and of compact size requiring low voltage power supplies.

The present invention addresses the problem of devising efficient power combining networks, power combining branching systems, or power combining trees for microwave frequencies. Individual solid state amplifiers, monolithic microwave integrated circuits (MMICs), are capable of producing at their output ports moderate power levels. At X band, 15 watts appears to be the nominal output power maximum available. Often the system power requirement surpasses this level by an order of magnitude. A 200 watt output would require the combining of many such MMICs and orthodox multi-port power combiners based on microstrip lines are lossy and therefore inefficient. The present invention allows the achievement of a 200 watt power using just sixteen MMICs at 15 watts each. The equivalent loss would be 40 watts in a potential 240 watts or less than 1.0 dB loss in the combiner.

SUMMARY OF THE INVENTION

In accordance with the present invention, a solution for low loss and high efficiency is provided by a novel transmission medium compatible with low loss, convenient for injection and extraction of power, and compact and consistent with the concept of a three dimensional power combiner unit.

The present invention provides for a power combiner having a two-dimensional array of power input ports. These input ports, which are antennas implemented along the edge of dielectric slabs, introduce the power to the dielectric slabs. The slabs act as guides for power flux streams from each antenna. The direction in the plane of each slab orthogonal to the direction of propagation is the "vertical" direction. The input antenna array is arranged along the edge of each slab in the vertical direction. Power streams in each slab are parallel. The slabs are waveguides that are "leaky", i.e. guides that radiate a substantial fraction of the power, thereby allowing merging between the parallel streams. These tendencies to radiate and allow merging of power are prevented, or allowed, according to the design of a metal cladding and routing system that completes the waveguide concept of the present invention. Merging of power streams within one slab, dictated by changes in the metal routing system, is a "vertical merge".

Multiple slabs are arranged in a linear array in the "horizontal" direction. Power transfer from one slab to another is accomplished by using the fact that the dielectric guides are "leaky" and are "controlled" by their dielectric thickness and by the metal pipe shielding. Slab to slab power transfer is referred to as "horizontal merging".

The power combining process of the present invention is the low loss transition from a many-waveguides-in-parallel situation to a single waveguide situation. This transition is accomplished, along the direction of propagation by successive vertical and horizontal merges so that the size of the two-dimensional array is reduced to a single output port.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which:

FIG. 3 is an elevational view of an additional embodiment of the present waveguide power combiner;

FIG. 4 is a sectional view taken generally along sectional lines 4—4 of FIG. 3;

FIG. 5 is an elevational view of the output port of the waveguide shown in FIGS. 3 and 4;

FIG. 6*a* illustrates an elevational view of a further embodiment of the present waveguide power combiner showing a vertical merge of four elements;

FIG. 6*b* illustrates a side view of the dielectric substrate of FIG. 6*a;*

DESCRIPTION OF THE PREFERRED EMBODIMENTS

The present invention teaches that dielectric losses are lower than metal losses in general and that a dielectric guide will provide, with appropriate choice of dielectric constant and low loss tangent (i.e. choice of dielectric material), lower insertion loss than any TEM metal based transmission line or any metal waveguide.

Figure 1:
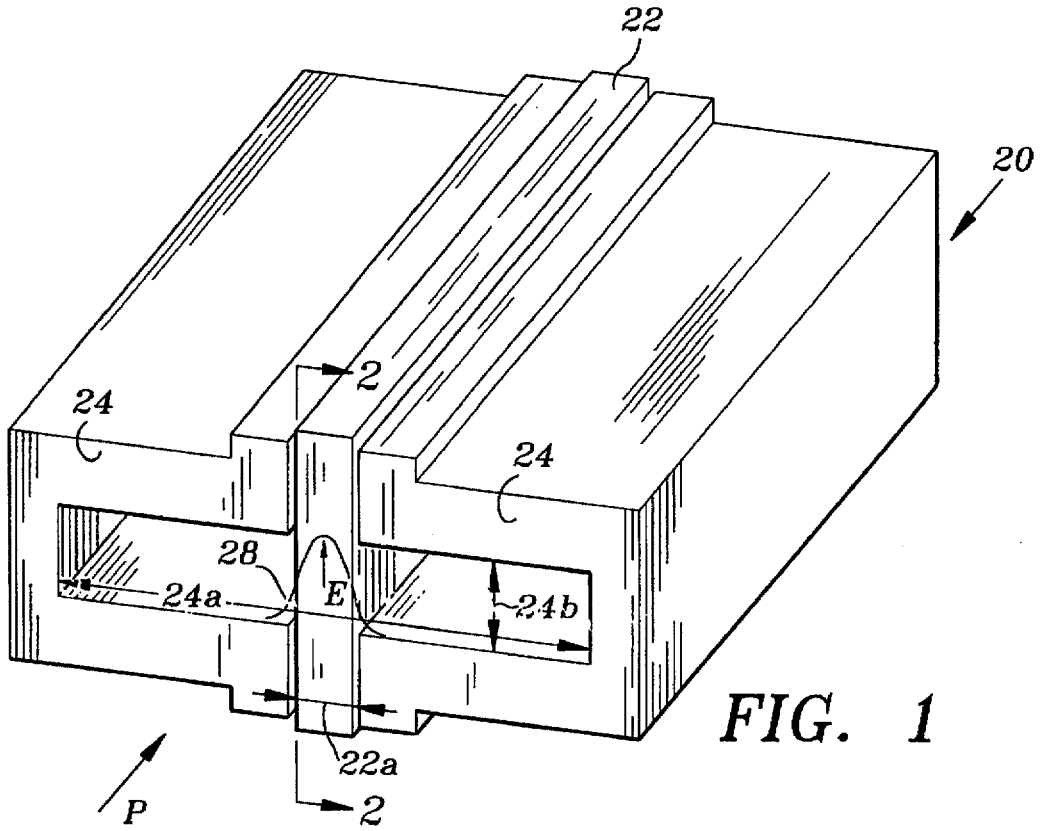
FIG. 1 is a perspective view of one embodiment of the present waveguide power combiner.

FIG. 1 illustrates an embodiment of the present waveguide, generally identified by the numeral 20. The waveguide 20 includes a dielectric slab 22, which for an X band application may comprise, for example, alumina with epsilon of 9.0 and loss tangent of less than 0.001. The dielectric slab 22 supports a wave with E field polarization parallel to the plane of slab 22. The slab width 22*a* is not sufficient to provide a lossless guide alone. By itself, the dielectric guide would be a very lossy guide in the sense that the energy would continually radiate away from the dielectric, i.e. it would be a leaky guide. The metal guide 24 completes the composite waveguide 20. The slab width 22*a* is sufficient to ensure that in the presence of the metal shield 24, the energy remains almost entirely inside the dielectric slab 22 and propagates along the guide 20, in a direction indicated by Poynting's vector P, in the dielectric slab 22 with very little surface current in the metal guide 24 needed to support the wave. Graph 28 illustrates the power density profile of a $TE_{10}$ mode in guide 20. The width 24*a* of the metal guide 24 is generally less than half the width of an empty metal guide that would have a cut-off frequency equal to the frequency at which the system is being used, i.e. width 24*a* would be less than a quarter wavelength at operating frequency.

Figure 2:
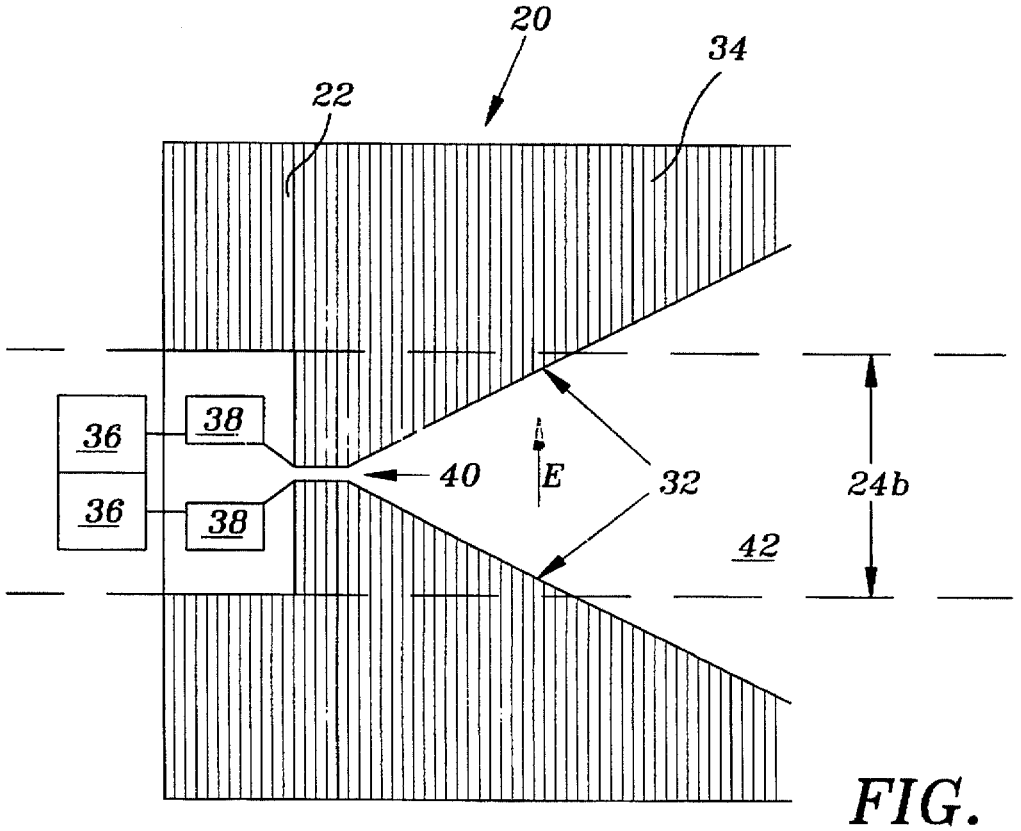
FIG. 2 is a sectional view taken generally along sectional lines 2—2 of FIG. 1.

Referring to FIG. 2, power is introduced into the composite guide 20 by use of a tapered slot antenna (TSA) 32. TSA 32 is created by placing a metal pattern 34 on the side of the dielectric slab 22. The power originates from the MMIC or MMICs 36. Two MMICs are illustrated to describe a push-pull system where anti-phase signals from the MMICs 36 are connected to matching networks 38 and from the output port of matching network 38 to each side of a slot line transmission system 40. Slot line transmission system 40 is immediately expanded to form the tapered slot antenna 32 which launches a power wave into the dielectrically loaded guide 20 and orients the E field. By correct choice of the guide height 24*b* (FIG. 1) and the length of the tapered region 42, an excellent low loss match can be achieved into the waveguide 20. The MMIC chips 36 would preferably be mounted off the dielectric slab 22 as illustrated in FIG. 2.

Power in two waveguides 20 may be smoothly and efficiently combined with low loss and excellent match when they are vertically disposed with respect to each other as seen in FIGS. 3–5. The vertical direction, v, is orthogonal to the direction of propagation, P, in the plane of dielectric slab 22. The horizontal direction, h, is orthogonal to the vertical direction. In this configuration two guides 20 share a common dielectric slab 22 to form a guide 46. Where the two guides 20 are isolated from each other, the guides share a common wall 48. Power combination is initiated when the common wall 48 is removed with a taper as illustrated at 50. There follows a region 52 of twice the height of the guide plus wall thickness, which provides a doubled impedance level, which aids the smooth matching and which is the "mixing" region.

The input ports of guide 46 are ports 60 and 62. The output port is port 64. The impedance level at port 64 is restored to the level of ports 60 and 62 by the region 66 which is a quarter wavelength section of the mean impedance level between the twice height region 52 are the input height 24*b* of guide 20. Waveguide impedance level is always directly proportional to waveguide height 24*b* even in the dielectric loaded guides 20.

When equal and in-phase signals are applied to ports 60 and 62, the power reflected back to pod 60 or port 62 is minimized substantially. This condition results because the "auto-reflected" power, i.e. S11 at port 60 or S22 at port 62, is equal in magnitude and in anti-phase with the "adjacent reflected" power, i.e. S12 at port 60 and S21 at port 62. Almost all the total power is transmitted into port 64 through the twice height section 52. The transition to a single height port 64 is the most critical aspect of design and is accomplished either by the quarter wave section of guide 46 or by use of a gradual ramp.

Power combining of multiple pairs of guides 20, vertically disposed with respect to each other, is possible using the techniques of the present invention. Referring to FIGS. 6*a* and 6*b* power combining of two pairs of guides 20 vertically disposed with respect to each other is shown. Four tapered slot antennas 32 are used to combine the output power of eight MMICs 36 operating in pairs of push-pull amplifiers. The common dielectric slab 70 may comprise, for example, aluminum nitride which has simple metal patterns to form the antennas 32. Slab 70 includes a taper 72 at the output edge to finally launch the power either as a propagating wave or into a full size empty metal waveguide appropriate to the frequency. The output power would be approximately 65 watts where MMICs 36 are 10 watt MMICs.

Figure 7:
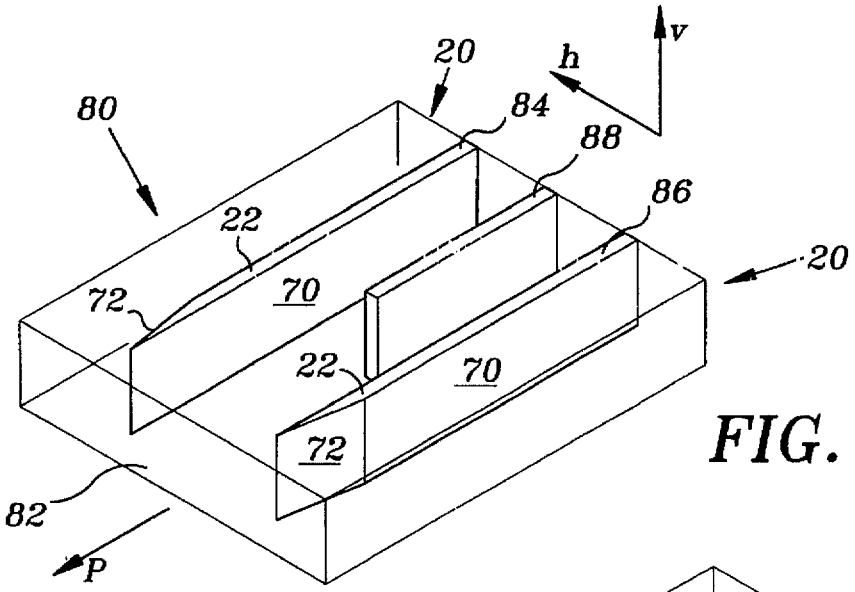
FIGS. 7 and 8 are perspective views of a further embodiment of the present waveguide power combiner illustrating a horizontal merge.
Figure 8:
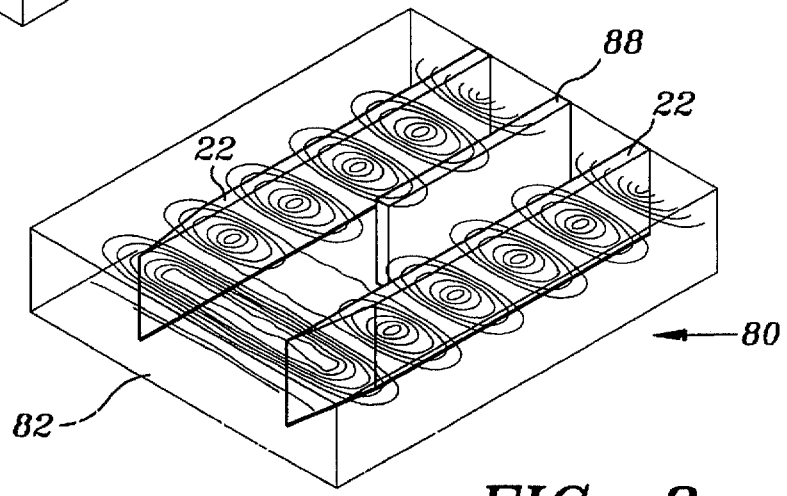

Power in two guides 20 or 46 can be smoothly and efficiently combined when they are horizontally disposed with respect to each other as seen in FIG. 7 to create a guide 80. Merging and combining just two guides 20 or 46 is illustrated. The output port 82 is a full width empty guide appropriate to the frequency. The input ports 84 and 86 are in reduced width and are beside each other. Power combination is initiated by terminating the common partition 88. Very shortly after the point at which the partition 88 disappears the dielectric guides are wedged or tapered at 72 to force the wave to assume the normal TE10 mode in the full width guide. FIG. 8 illustrates the intensity of the square of electric field as a function of position in a snapshot of the E field of guide 80. The merging begins well before the forcing of the energy out of the dielectric slabs as they begin to taper to zero thickness.

Figure 9:
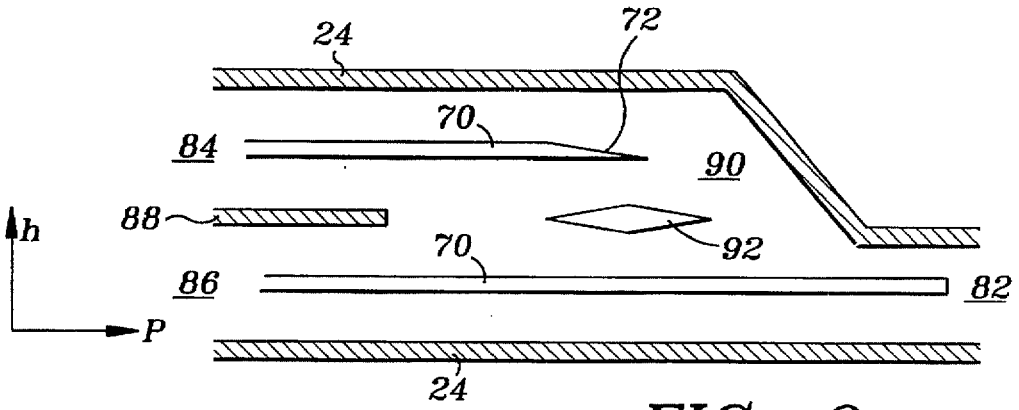
FIG. 9 illustrates a horizontal merge of the present waveguide power combiner.
Figure 10:
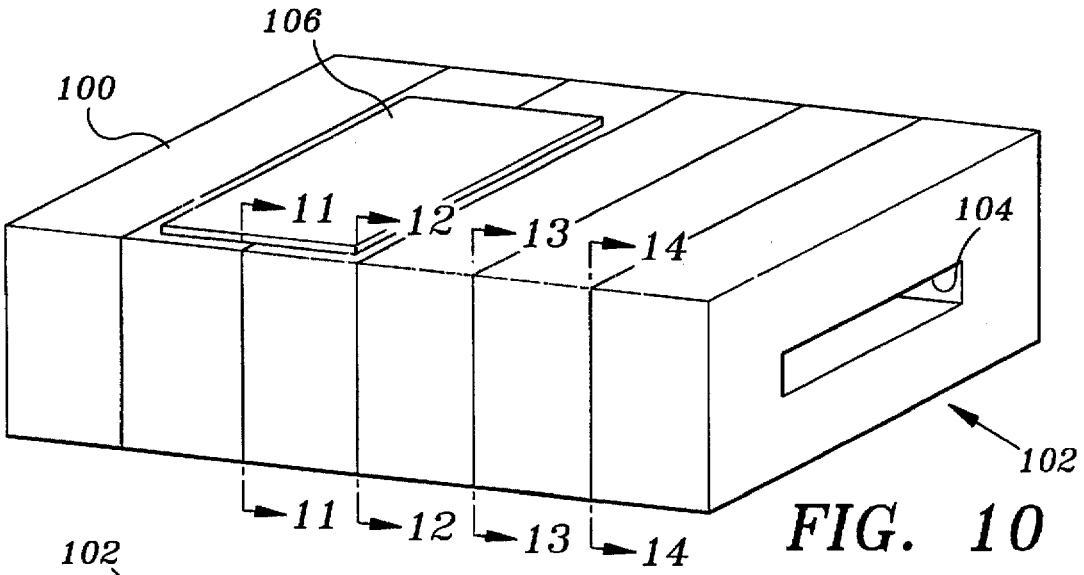
FIG. 10 is a perspective view of all major embodiments of the present waveguide power combiner including horizontal and vertical merges and a method for isolating different elements of the combiner from each other.
Figure 11:
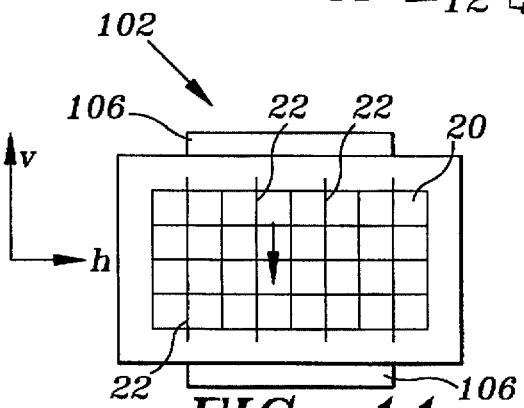
FIG. 11 is a sectional view taken generally along sectional lines 11—11 of FIG. 10.
Figure 12:
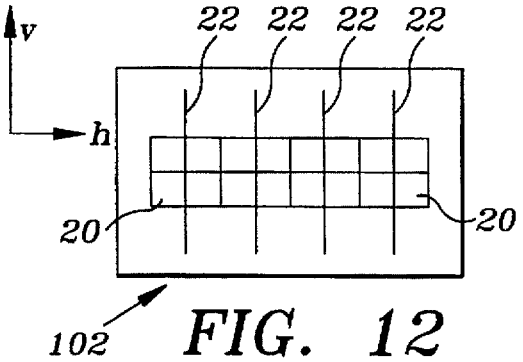
FIG. 12 is a sectional view taken generally along sectional lines 12—12 of FIG. 10.
Figure 13:
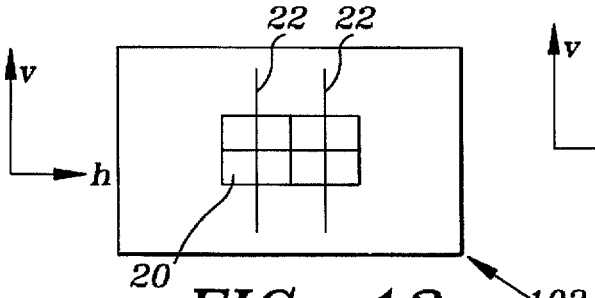
FIG. 13 is a sectional view taken generally along sectional lines 13—13 of FIG. 10.
Figure 14:
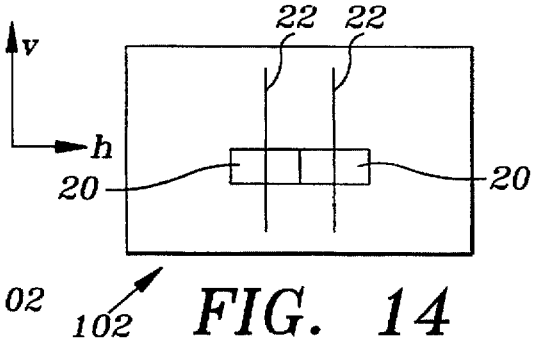
FIG. 14 is a sectional view taken generally along sectional lines 14—14 of FIG. 10.
Figure 15:
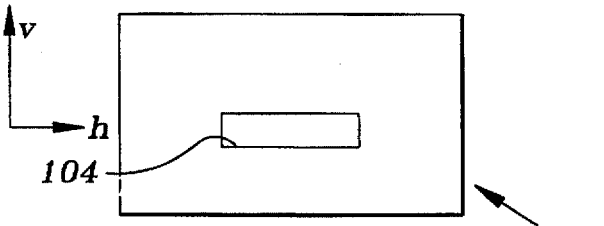
FIG. 15 is an elevational view of the output port of the waveguide shown in FIG. 10.

FIG. 9 illustrates an additional embodiment of the present guide, which allows an array of more than two guides 20 or 46 horizontally arranged with respect to each other to be power combined in a manner similar to FIGS. 6*a* and 6*b*. The region 90 downstream from the removal of the common partition 88 is tapered in width and the dielectric 70 of just one of the guides is tapered at 72 so as to effect the transfer of power from guide 84 to guide 86. Introduction of a third and short dielectric wedge 92 is used as a tuning and matching adjustment mechanism for this transfer.

Guide 20 is intended to provide a low loss transmission line which is compatible with power combining or with the operations so essential to power combining, that is, transfer of power in low-loss, low-mismatch media. A further embodiment of the present invention is in a three dimensional power combining unit, which encompasses all of the previous embodiments and which is compatible with power levels in the 1000 watt regime.

Referring to FIGS. 10–15, an array of 16 pairs of push pull amplifiers is mounted in a metal housing 100 to form a power combiner assembly 102. Housing 100 is metal in order to supply advantages in the matter of handling waste heat. The power combiner assembly 102 will provide power combining in the manner described above by combining the power present in all sixteen guides 20 into one single waveguide with the output port 104. The combining of power is accomplished through a series of successive vertical and horizontal merges as illustrated by the section drawings of FIGS. 11–15.

A block-like structure of the three dimensional combiner is consistent with construction from lightweight materials. The body may be metal coated plastic and is not needed to handle the waste energy from the MMICs housed in section 100. As a further embellishment, a resonance isolator using a microwave ferrite material is placed on one side of each dielectric slab. A magnetic field, Hdc, derived from a magnet 106, parallel with the orientation of the E fields, will isolate each of the sixteen guides 20 from each other.

It therefore can be seen that the present waveguide combiner utilizes an assembly of power amplifier devices to launch power from each device into a dielectric waveguide. The present invention utilizes tapered-slotted antennas to launch the power into dielectric waveguides. The dielectric guide can be integrated into a conventional waveguide to thereby form a waveguide within a waveguide. Additionally, the present invention provides for high-level power combining by vertical and horizontal waveguide merging operations. The present combiner results in a high power combining device with low-loss and small physical size.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A waveguide power combiner having an input and an output comprising:

a plurality of waveguides for receiving the input, said plurality of waveguides extending in a vertical and a horizontal direction;

dielectric substrates disposed within said plurality of waveguides in the vertical direction, said dielectric substrates each having a variable thickness ranging from a maximum thickness to a minimum thickness for transmitting power to said waveguides, said dielectric substrates each include a plurality of tapered-slotted antennas, such that at least one antenna is associated with each waveguide; and means for combining said plurality of waveguides into a reduced number of waveguides, such that said reduced number of waveguides provide the combiner output.

2. The waveguide combiner of claim 1 wherein said combining means reduces said plurality of waveguide elements into a single waveguide element.

3. The waveguide power combiner of claim 1 wherein said plurality of tapered-slotted antennas include slot line feeders.

4. A waveguide power combiner having an input and an output comprising:

a plurality of waveguides for receiving the input, said plurality of waveguides extending in a vertical direction;

a dielectric substrate disposed within said plurality of waveguides in the vertical direction, said dielectric substrate having a variable thickness ranging from a maximum thickness to a minimum thickness for transmitting power to said waveguides, said substrate includes a plurality of tapered-slotted antennas, such that at least one antenna is associated with each waveguide; and means for combining said plurality of waveguides into a reduced number of waveguides, such that said reduced number of waveguides provide the combiner output.

5. The waveguide power combiner of claim 4 wherein said plurality of tapered-slotted antennas include slot line feeders.

6. A waveguide power combiner having an input and an output comprising:

a plurality of waveguides for receiving the input, said plurality of waveguides extending in a horizontal direction;

dielectric substrates disposed within said plurality of waveguides in the vertical direction, said dielectric substrates each having a variable thickness ranging from a maximum thickness to a minimum thickness for transmitting power to said waveguides, said dielectric substrates each include a plurality of tapered-slotted antennas, such that at least one antenna is associated with each waveguide; and means for combining said plurality of waveguides into a reduced number of waveguides, such that said reduced number of waveguides provide the combiner output.

7. The waveguide power combiner of claim 6 wherein said plurality of tapered-slotted antennas include slot line feeders.

* * * * *